United States Patent [19]

Partington et al.

[11] Patent Number: 5,001,830

[45] Date of Patent: Mar. 26, 1991

[54] METHOD FOR ASSEMBLING SIDE ENTRY CONTROL STAGE BLADES IN A STEAM TURBINE

[75] Inventors: Doretta H. Partington; Albert J. Partington, both of Winter Springs, Fla.

[73] Assignee: Westinghouse Electric Corp., Pittsburgh, Pa.

[21] Appl. No.: 429,531

[22] Filed: Oct. 23, 1989

[51] Int. Cl.[5] ..... B23P 15/02

[52] U.S. Cl. ..... 29/889.21; 29/406; 29/445; 29/889.22

[58] Field of Search ..... 416/191, 190, 193 A, 416/189; 29/889, 889.2, 889.21, 889.22, 406, 445

[56] References Cited

U.S. PATENT DOCUMENTS

| | | | |
|---|---|---|---|
| 2,272,831 | 2/1942 | Chaluda | 416/219 R |
| 2,277,484 | 3/1942 | Flanders | 416/219 R |
| 2,429,215 | 10/1947 | Boestad | 416/219 R |
| 2,548,886 | 4/1951 | Howard | 29/889.2 |
| 2,781,998 | 2/1957 | Barr | 416/220 R |
| 3,008,689 | 11/1961 | Morley et al. | 416/193 A |
| 3,014,695 | 12/1961 | Rankin et al. | 16/220 R |
| 3,745,628 | 7/1973 | Stahl | 29/445 |
| 4,118,847 | 10/1978 | Mansson et al. | 29/889.2 |
| 4,130,379 | 12/1978 | Partington | 416/193 |
| 4,718,172 | 1/1988 | Rouse et al. | 33/530 |
| 4,765,046 | 8/1988 | Partington et al. | 29/156.8 |
| 4,798,520 | 1/1989 | Partington et al. | 29/889.21 |

FOREIGN PATENT DOCUMENTS

| | | | |
|---|---|---|---|
| 25905 | 2/1977 | Japan | 416/212 A |
| 70253 | 6/1977 | Japan | 416/219 R |
| 26210 | 2/1982 | Japan | 416/212 A |
| 0199180 | 6/1923 | United Kingdom | 29/889.21 |
| 613667 | 12/1948 | United Kingdom | 416/212 A |

*Primary Examiner*—Howard N. Goldberg
*Assistant Examiner*—I. Cuda

[57] ABSTRACT

A method of assembling side entry control stage blades in a rotor of a steam turbine, each blade including a cover, an airfoil, a platform and a root. The cover and the platform of each blade include leading and trailing surfaces which abut mating surfaces of the cover and the platform of an adjacent blade. The blades are installed in the turbine rotor, each blade centerline aligned along a radial line of the rotor. To establish tight contact between adjacent covers and between adjacent platforms, a wedge is inserted between the top of a rotor steeple and a bottom of a blade platform along one side of each blade. A shroud is riveted onto the covers of adjacent control stage blades which maintains the tight contact established by the wedges. The wedges are removed afer shroud attachment. The leading and trailing surfaces in one form may have an arcuate shape to provide better shock transfer in more than one direction. The blades of a group in one form may have mass eccentricity which clamps the interior blades tight between the end blades of the group.

13 Claims, 2 Drawing Sheets

METHOD FOR ASSEMBLING SIDE ENTRY CONTROL STAGE BLADES IN A STEAM TURBINE

BACKGROUND OF THE INVENTION

This invention relates to steam turbines and, more particularly, to a method of assembling side entry control stage blades to a rotor of a steam turbine.

Control stage blades operating in a partial-arc admission steam turbine receive a shock load at the entrance and exit of each admission zone. A single blade is not sufficiently strong to withstand such repetitive shock load forces. Therefore, control stage turbine blades are generally joined into predetermined groups so that as each blade successively receives a shock load, the load is distributed over the entire group of blades. Because control stage blades are subjected to such shock loading forces and are joined in groups, the assembly or installation of such blades into a turbine requires different procedures than for other blades.

It has become common practice to join individual control stage blades into groups of blades by attachment of the blades to a common platform and/or to a common shroud portion. Such multiple blade units have higher rigidity and lower vibration susceptibility than single blades. In one form, a blade group may be constructed by attaching radially outer ends of several blades to a shroud after the blade roots are inserted into their respective rotor grooves. In another form, blade groups may be constructed as integral units having a common shroud and a common platform. Such a blade group is illustrated in U.S. Pat. No. 4,130,379 to Partington and assigned to the assignee of the present invention. These prior art assemblies, however, do not provide for the assembly of individual blades with tight contact between the blades within a group while providing thermal expansion clearances between groups of control stage blades.

For ease of assembly, the individual blades are presently assembled with clearances between the covers and the platforms. The shroud is then riveted to the top of the covers to connect the blades together. A disadvantage to this assembly is that slight movements between the cover and the shroud due to partial admission shock loads prevent even distribution of shock load forces to blades in a group. Uneven distribution of shock load forces may cause excessive vibratory root bending stresses and root cracking. Clearances between covers and platforms also result in lower efficiency due to leakage.

SUMMARY OF THE INVENTION

Among the several objects of the present invention is the provision of a method and apparatus for assembling control stage blade groups to facilitate transmission of partial admission shock load forces to all blades in a group. More specifically, it is an object of the present invention to provide a method for assembling a control stage blade group in which tight contact is maintained between the blades within a group while allowing clearance for thermal expansion between the groups.

Another object of the present invention is to provide a method for assembling a cover and a platform on side entry control stage blades to prevent relative motion between such blades. As this assembly process creates and maintains tight contact between covers and between platforms of the individual blades during operation of a steam turbine, the transmission of shock load forces will be more evenly distributed to the predetermined number of control stage blades.

In one form of the present invention, a first blade is installed in a radial line and held firmly in place with an anchor support. A second blade is installed and its deviation from a radial orientation is measured. This second blade is then removed and its mating surface on the cover and platform are machined by the exact amount that will bring the covers and the platforms into tight contact while, at the same time, the blade center line is radial within a prescribed tolerance. A wedge is inserted, on one side, between the platform bottom and the root top in order to maintain tight contact between the covers of the individual blades. The blade is then shimmed under the bottom of the root for additional support. Other blades in the group of side entry control stage blades are installed in the same manner as that of the aforementioned second blade. Insertion of a spacer between groups provides an anchor support for the installation of a following group. Subsequently, the spacer is removed. The gap, which results from removal of the spacer, allows for thermal expansion. Each group of control stage blades is clamped tightly together with a hydraulic jack or other means during the shroud riveting process so that tight contact will be maintained. Upon completion of the blade row assembly process (including the shroud riveting process), the platform wedges are removed and the root shims are either removed or cut off.

In another form of the present invention, mass eccentricity is built into the individual blades which will be opposite at the leading and trailing ends of the group. This mass eccentricity maintains pressure between covers and platforms during operation. Side entry control stage blades are able to withstand the steady bending moment in the root due to eccentric force because average root stresses in control stage blading are generally low.

In yet another form of the present invention, a circular arc mating surface between covers and platforms may be used to provide even more effective transmission of shock load forces. These circular surfaces allow contact in more than one direction and conform more to the shape of the airfoil than the current flat-sided surfaces on the cover and platform. The convex side of the cover and the platform is on the convex side of the airfoil, and the concave side of the cover and the platform is on the concave side of the airfoil. The present invention provides an assembly which creates and maintains tight contact between side entry control stage blades within a group of control stage blades while allowing clearances for thermal expansion between the groups of control stage blades in a steam turbine.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
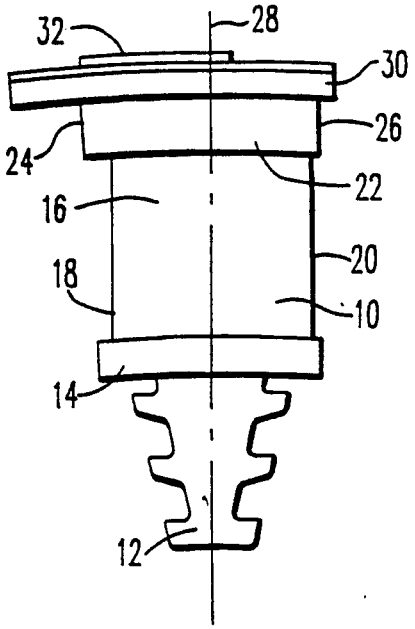
FIG. 1 (PRIOR ART)
FIG. 1 is an elevational view of a blade.

Turning now to the drawings in detail and in particular to FIG. 1, there is shown an exemplary turbine blade 10 including a blade root 12 formed in a Christmas-tree shape, a base or platform 14 interposed between the root 12 and an outwardly extending radially airfoil shaped blade portion 16 having leading and trailing edges 18 and 20, respectively. Disposed outwardly of the blade portion 16 and made integral therewith is a cover 22. The cover 22 includes a leading planar surface 24 and a trailing planar surface 26. The leading and trailing planar surfaces 24 and 26, respectively, are generally parallel to an axial radial plane 28 passing through the center of the root 12. A shroud 30 is securely fastened to an outer surface of cover 22 of the exemplary blade and selected adjacent blades such as by rivets 32 in order to form the blades into groups of a preselected number.

Figure 2:
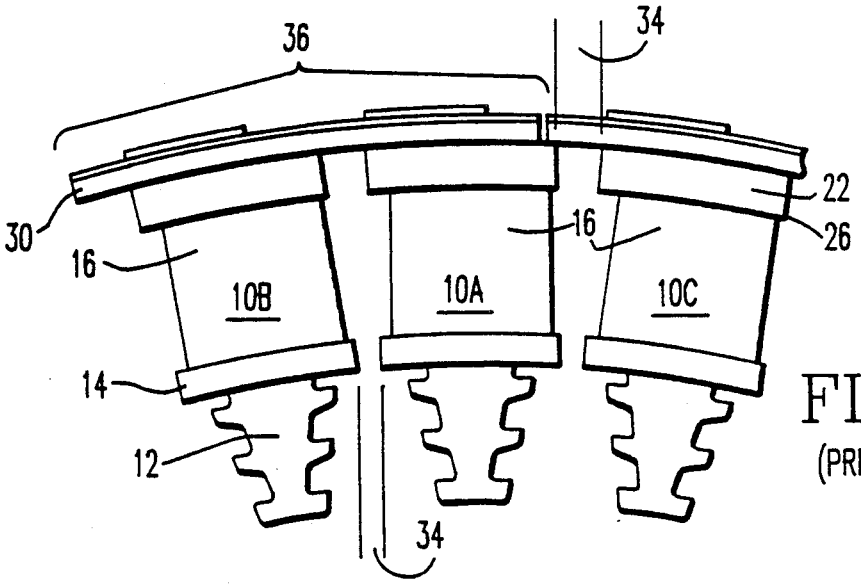
FIG. 2 (PRIOR ART)
FIG. 2 is an elevational view of a prior art assembly of side entry control stage blades.

FIG. 2 illustrates a plurality of adjacent side entry control stage blades assembled in a prior art arrangement in which blades 10A and 10B are in a first group 36 and blade 10C is in a second group. The blades are assembled with clearances 34 between adjacent covers 22 and adjacent platforms 14. Blades within a group are joined by a shroud 30 which provides some distribution of loading across the blade group. The clearances 34 have been believed useful in accommodating thermal expansion. However, Applicants have found that the clearances 34 contribute to root cracking in partial-arc turbines because such clearances prevent shock load forces from being evenly distributed to all blades 10 of a blade group. Additionally, the clearances 34 may allow movement and consequent fretting of the root 12. This root movement can result in reduction of fatigue strength and lead to blade failure. Still further, gaps or clearances 34 allow leakage and may adversely affect turbine efficiency.

Figure 3:
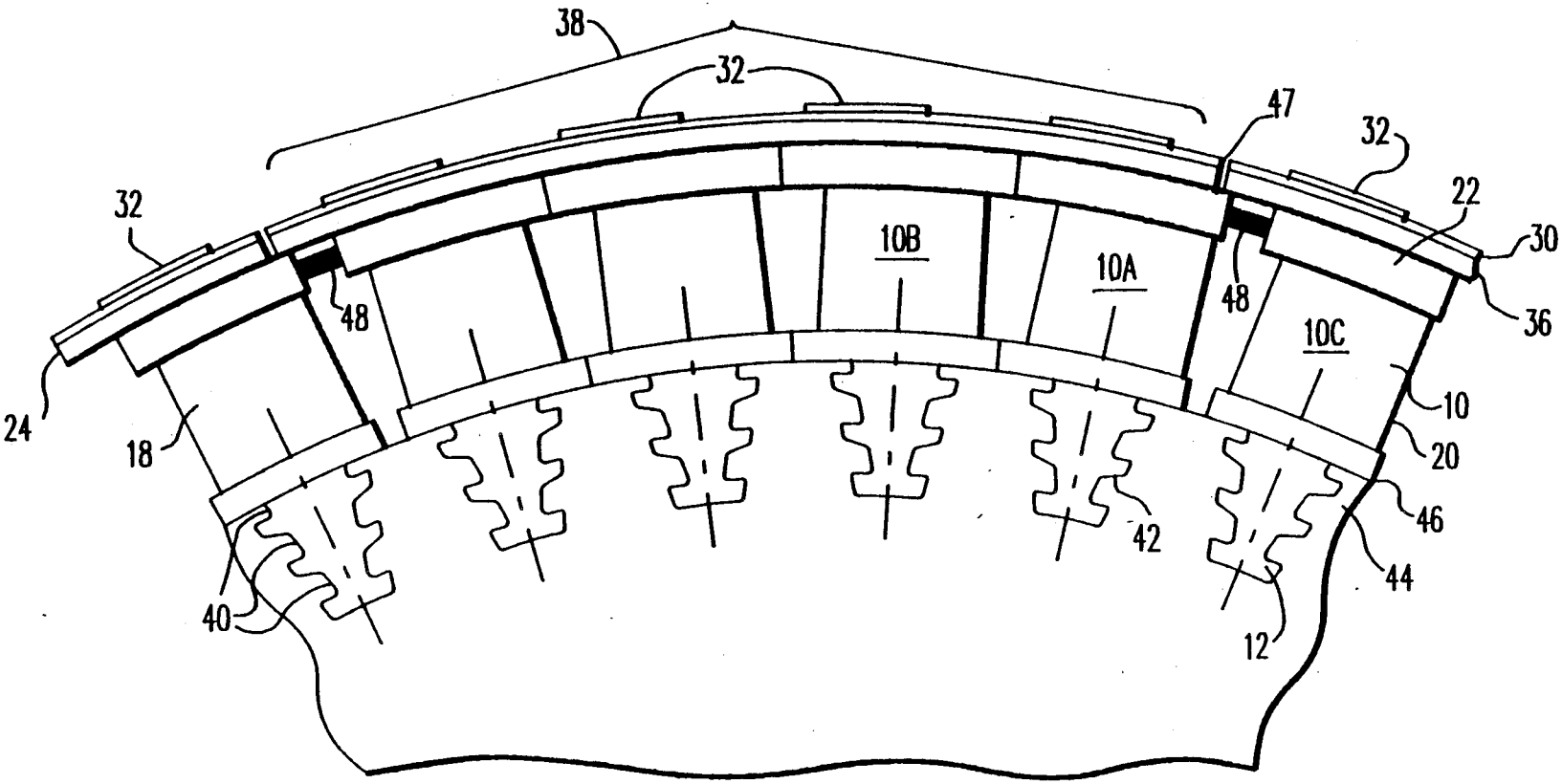
FIG. 3 is a partial cross-sectional view of side entry control stage blades disposed in a rotor.

The present invention, illustrated in one form in FIG. 3, provides for an assembly of side entry control stage blades 10 without the clearances 34 between adjacent ones of the platforms and covers. The circular array or group 38 of control stage blades 10 is shown assembled to a portion of a turbine rotor 40. The rotor 40 includes a plurality of circumferentially spaced grooves 42 separated by steeples 44. The grooves 42 are shaped to mate with the blade roots 12 for holding and supporting the blades 10 about the rotor 40.

The method of assembling the circular array of blades 38 in accordance with the present invention comprises sequentially inserting each control stage blade 10 into the rotor 40 by sliding the root 12 into a corresponding groove 42 in the rotor 40. The first blade so inserted is used as a reference blade and is installed on a radial line and held firmly in place with an anchor support. A radial position gage such as described in U.S. Pat. No. 4,718,172 may be used to align the first blade. Anchor supports for supporting a first blade are well known in the turbine art and are not illustrated herein. The first blade, along with all subsequently installed blades, is shimmed under its root bottom as it is installed. The shims (not shown) may be removed or simply cut off after completion of the assembly process.

Each succeeding blade 10 is installed with reference to the first blade. In particular, a second blade is inserted into position adjacent the first blade and its deviation from a radial orientation measured. The blade is then removed and its mating surfaces on its cover and platform are machined by an exact amount which will bring its cover and platform into tight contact with the cover and the platform of the reference first blade while maintaining the blade centerline (within a predetermined tolerance). The second blade is then reinserted in its prescribed groove and a wedge 46 driven under its platform on the side away from the reference blade so as to force and maintain the tight contact between the adjacent first and second blades. A third and succeeding blade is then installed in the same manner as the second blade until a preselected number of blades has been installed. The preselected number, which may be, for example, four, establishes a group 38 of blades which are to be joined together to better withstand shock loads. A first shroud 30 is then positioned over the abutting covers 22 of the blade group and riveted or otherwise fastened to each blade cover. The wedges are then removed so that only the shroud 30 remains to secure the blades 10 in their tightly abutting assembly. If desired, a hydraulic clamp or other means may be used to restrain the blades 10 while the shroud is being riveted to the covers.

While it is desirable to eliminate spacing or clearance 34 between adjacent ones of the blades 10 within a particular group 38 of blades to facilitate sharing of shock loads across the group, it is also desirable to allow spacing within a row or circumferential array of blades to accommodate thermal expansion. In the present invention, such thermal expansion can be accommodated by a spacing or clearance between adjacent groups of blades. In FIG. 3, a spacer 48 is shown between covers 22 of adjacent blades 10A and 10C. During assembly of the blades 10 to the rotor 40, each group 38 of blades is successively assembled to the rotor. After a first group is assembled, the first blade of a second group, for example, blade 10C, is installed in the rotor 40 adjacent the first group. The spacer 48 is inserted between the adjacent covers 22 of blades 10A and 10C and a wedge 46 driven between the platform 14 of blade 10C and a respective one of the steeples 44 thereby wedging blade 10C tightly against adjacent blade 10A but spaced therefrom by spacer 48. The remaining blades of the group are then sequentially installed and wedged until the group is complete with, e.g., four blades. A second shroud 30 is fastened to this second group of blades, with a space 47 at least equal to the thickness of spacer 48 between an end of the first shroud 30 and an adjacent end of the second shroud 30. Thereafter, the wedges 46 and spacer 48 are removed so that the second shroud 30 maintains the tight abutment between all of the blades 10 of the second group. Each of the remaining groups of blades necessary to complete the blade row are then installed and assembled in the same manner.

Figure 4:
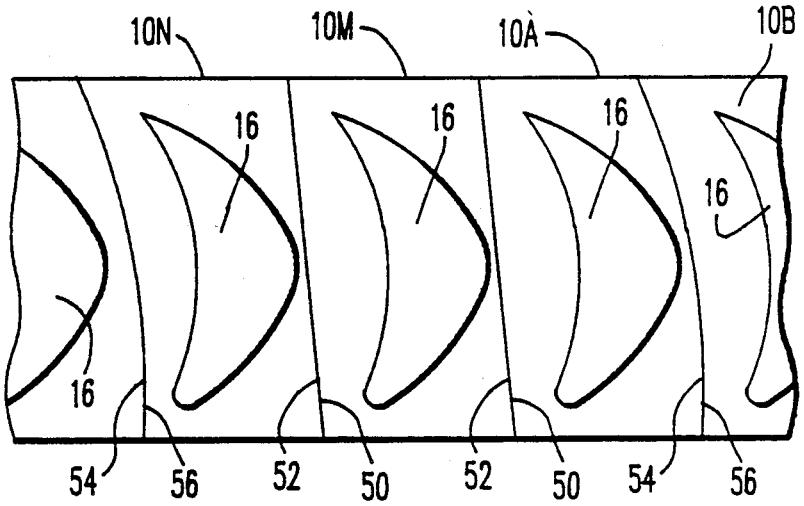
FIG. 4 is a top plan view of circular arc blades disposed in a rotor.

Applicants have also found that the shock loading and other blade related forces can be more effectively transmitted between blades if the abutting surfaces are arcuate rather than straight. Turning now to FIG. 4, there is illustrated a top plan view of a partial row of assembled side entry control stage blades 10. FIG. 4 shows a first installed blade 10A in a circular row, a penultimate blade 10N and a final blade 10M. The remaining blades 10B are substantially identical. The blade 10M is characteristic of the prior art blades, i.e., it has substantially straight sides or surfaces 50, 52 on both the cover 22 and platform 14. In comparison, the blades 10B are constructed with curved or arcuate sides or surface 54, 56 on both the cover 22 and platform 14.

Note that the surface 54 is convex while the surface 56 is concave so as to form mating surfaces with adjacent blades. The first blade 10A is formed with a convex surface 54 on one side of its cover and platform for mating with adjacent concave surfaces on a blade 10B. The opposite side of the cover and platform of blade 10A is formed with a straight surface 50 which mates with surface 52 of blade 10M. Similarly, the penultimate blade 10N has a concave surface 56 on one side of its cover and platform for mating with a convex side 54 of the cover and platform adjacent blade 10B. An opposite side 52 of the cover and platform of blade 10N is formed with a straight surface for mating with surfaces 52 of blade 10M. The blade 10M has both side surfaces straight to enable it to be slidingly inserted as the final blade in the blade row. Preferably, the convex sides of the cover and platform are on the convex side of the airfoil blade portion 16 while the concave side is aligned with the concave side of the airfoil portion 16.

Among the advantages of the circular or arcuate shaped sides of the cover and platform is that the arcuate shape allows contact between mating surfaces in more than one direction. Furthermore, the arcuate shape conforms more to the shape of the airfoil blade portion 16 and can better react to the forces on the airfoil portion. The curvature can be selected to minimize interference during assembly. The flat sided final blade 10M allows it to be easily positioned to close the blade row.

The method described hereinbefore advantageously provides a process of assembling side entry control stage blades in order to achieve tight contact between covers and platforms within each group of control stage turbine blades while permitting a clearance between blade groups to allow for thermal expansion. Additionally, a mass eccentricity may be built into the individual side entry control stage blades which is opposite at the leading and trailing ends of each group of blades. Such a mass eccentricity will result in a centrifugal force that will maintain a clamping action between the blades during rotation. While this mass eccentricity will create a steady eccentric moment acting on the blade roots, the average blade root stresses in the control stage blades are sufficiently low to preclude any adverse effects of the steady eccentric moment.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the claims which follow.

What is claimed is:

1. A method of assembling side entry control stage blades to a rotor of a steam turbine, the blades having a cover, a platform, an airfoil interposed between the cover and platform, and a root extending from a bottom surface of the platform opposite the airfoil, each of the cover, the airfoil, and the platform having respective leading and trailing surfaces, the rotor including a plurality of circumferentially spaced grooves each adapted for receiving a root of a respective blade, the rotor grooves spaced from one another by intervening steeples, the method comprising the steps of:

installing a first blade in a preselected one of the rotor grooves with a centerline of the blade aligned along a radial line of the rotor;

intalling another blade in another of the rotor grooves adjacent the first blade such that one of the leading and trailing surfaces of each of the cover and platform of the another blade is in tight contact with one of the leading and trailing surfaces of the cover and platform of the first blade while maintaining a centerline of the another blade substantially aligned with a radial line of the rotor;

driving a wedge under the platform of the another blade along a side opposite the first blade so as to force the cover and platform of the another blade into tight contact with the first blade;

installing yet another blade into yet another rotor groove adjacent the another groove such that one of the leading and trailing surfaces of each of the cover and platform of the yet another blade is in tight contact with one of the leading and trailing surfaces of respective ones of the cover and platform of the another blade while maintaining a centerline of the yet another blade substantially aligned with a radial line of the rotor;

driving a wedge under the platform of the yet another blade along a side opposite the another blade so as to force the covers and platforms of the adjacent blades into tight contact;

repeating the steps of installing yet another blade and driving a wedge thereunder for a preselected number of blades to form a blade group;

overlaying a shroud over the blade group and fastening the shroud to each of the covers of the blades in the group to unite the blades into the group;

removing the wedges from under the blade platforms so that the shroud provides the force to maintain the blades in tightly abutting contact; and repeating the steps of installing a first blade through the step of removing the wedges to form a plurality of blade groups sufficient to fill a blade row.

2. The method as recited in claim 1 wherein the steps of installing another blade and installing yet another blade each comprises the steps of:

temporarily inserting a blade into a rotor groove;

measuring any deviation of the blade centerline from a rotor radial line;

removing the blade from the rotor;

machining one of the leading and trailing surfaces of each of the cover and platform of the blade by an amount to bring the machined surfaces into contact with mating surfaces of an adjacent blade while aligning the blade centerline with a rotor radial line; and reinserting the machined blade into the rotor groove.

3. The method as recited in claim 1 further comprising the steps of:

inserting a spacer between a last blade in each of the groups of blades and a first blade in each adjacent group of blades as each first blade is installed so that a preselected spacing is established between each group of blades; and removing the spacer concurrently with removal of the wedges in each blade group.

4. The method as recited in claim 1 and further comprising the step of:

clamping each group of blades in a circumferential direction prior to the step of overlaying and fastening the shroud to thereby further tighten the abutting contact between respective covers and platforms of the blades in the blade group.

5. The method of claim 1 and further comprising the step of:

machining each of the blades in a blade group prior to the installing steps to establish a mass eccentricity which varies in an opposite direction from the first blade in a group to the last blade in the group so as to create a centrifugal force upon rotation of the blades about a rotor in a direction to maintain a clamping force between the blades.

6. The method of claim 1 and further comprising the step of:

forming the leading and trailing surfaces of the cover and the platform of at least some of the blades with an arcuate shape.

7. The method of claim 6 wherein the step of forming comprises the steps of:

forming the leading surface of each of the cover and platform into a convex curve; and forming the trailing surface of each of the cover and platform into concave curve.

8. The method of claim 6 wherein the step forming the leading and trailing surfaces comprises the steps of:

forming the first blade in the row of control stage blades with one of the leading and trailing surfaces of each of the cover and platform having an arcuate shape and the other of the leading and trailing surfaces having a straight surface;

forming the penultimate blade in the row of control stage blades with one of the leading and trailing surfaces of the cover and platform facing away from the first blade having an arcuate shape and the other opposite surface having a straight surface;

forming the last blade in the row of control stage blades with straight surfaces on both the leading and trailing surfaces on the cover and platform for mating with respective ones of the straight surfaces on the first and penultimate ones of the blades; and forming the remaining blades in the row of control stage blades with arcuate opposed mating surfaces on each of the leading and trailing surfaces of their respective covers and platforms.

9. The method of claim 2 and further comprising the steps of:

inserting a spacer between a last blade in each of the groups of blades and a first blade in each adjacent group of blades as each first blade is installed so that a preselected spacing is established between each group of blades; and removing the spacer concurrently with removal of the wedges in each blade group.

10. The method of claim 2 and further comprising the step of:

clamping each group of blades in a circumferential direction prior to the step of overlaying and fastening the shroud to thereby further tighten the abutting contact between respective covers and platforms of the blades in the blade group.

11. A method of assembling side entry control stage blades to a rotor of a steam turbine, the blades having a cover, a platform, an airfoil interposed between the cover and platform, and a root extending from a bottom surface of the platform opposite the airfoil, each of the cover, the airfoil, and the platform having respective leading and trailing surfaces, the rotor including a plurality of circumferentially spaced grooves each adapted for receiving a root of a respective blade, the leading and trailing surfaces of the cover and the platform of at least some of the blades having an arcuate shape, the method comprising the steps of:

selecting a first blade having one of the leading and trailing surfaces of each of the cover and platform having an arcuate shape and the other of the leading and trailing surfaces having a straight surface;

installing the selected first blade in a preselected one of the rotor grooves with a centerline of the blade aligned along a radial line of the rotor;

sequentially selecting and installing each of a plurality of additional blades in rotor grooves lying in the same row as the first blade, each of the additional blades having respective concave and convex surfaces on their covers and platforms arranged for mating with concave and convex surfaces on adjacently positioned blades so that covers and platforms of adjacent blades are in tight contact;

selecting a penultimate blade in the row of blades having an arcuate surface on its cover and platform oppositely disposed from the first blade, the remaining surfaces on its cover and platform having straight surfaces;

installing the penultimate blade so that its arcuately shaped surfaces on cover and platform are in tight contact with surfaces of an adjacent blade; and selecting and installing a final blade in the blade row having straight surfaces on its leading and trailing edges of its cover and platform so that it can be slid into a space between the first and penultimate blades.

12. A method for assembling side entry control stage blades to a rotor of a steam turbine, the side entry control stage blades including a cover, an airfoil, a platform, and a root, each of the cover, the airfoil, and the platform having respective leading and trailing surfaces, the rotor including a plurality of circumferentially spaced grooves each adapted for receiving a root of the blades, each groove being spaced from an adjacent groove by an intervening steeple, the method comprising the steps of:

inserting a preselected number of adjacently positioned side entry control stage blades into the rotor by sliding the blade roots into corresponding ones of the rotor grooves;

driving wedges between a bottom surface of at least some of the blade platforms and a corresponding adjacent steeple so as to force adjacent leading and trailing surfaces of the respective covers and platforms into tightly abutting contact;

fastening a shroud onto and overlaying all the covers of the preselected number of control stage blades to maintain tight contact between adjacent ones of the covers and platforms; and removing the wedges from between the top of the steeples and respective ones of the platforms so that the shroud provides the restraining force to maintain tight contact between covers and platforms of adjacent blades.

13. The method of claim 12 and including the additional steps of:

repeating the steps of inserting through the step of removing for each of a predetermined number of preselected numbers of control stage blades to create a row of blades;

inserting a spacer between each of the predetermined number of preselected numbers of side entry control stage blades therebetween for thermal expansion; and removing the spacer concurrently with the step of removing the wedges.

* * * * *